US011300012B2

(12) United States Patent
Baker, Jr.

(10) Patent No.: US 11,300,012 B2
(45) Date of Patent: Apr. 12, 2022

(54) POWER SYSTEM WITH CARBON DIOXIDE WORKING FLUID

(71) Applicant: Kenneth Colin Baker, Jr., Winchester, CA (US)

(72) Inventor: Kenneth Colin Baker, Jr., Winchester, CA (US)

( * ) Notice: Subject to any disclaimer, the term of this patent is extended or adjusted under 35 U.S.C. 154(b) by 25 days.

(21) Appl. No.: 16/694,767

(22) Filed: Nov. 25, 2019

(65) Prior Publication Data

US 2020/0165940 A1 May 28, 2020

Related U.S. Application Data

(60) Provisional application No. 62/771,510, filed on Nov. 26, 2018.

(51) Int. Cl.

| | |
|---|---|
| ***F01K 25/10*** | (2006.01) |
| ***F01K 27/00*** | (2006.01) |
| ***F01K 7/32*** | (2006.01) |
| ***F01K 7/36*** | (2006.01) |

(52) U.S. Cl.

CPC ..... *F01K 25/103* (2013.01); *F01K 7/32* (2013.01); *F01K 7/36* (2013.01); *F01K 27/00* (2013.01)

(58) Field of Classification Search

CPC . F01K 25/103; F01K 7/32; F01K 7/36; F01K 27/00

See application file for complete search history.

(56) References Cited

U.S. PATENT DOCUMENTS

| | | | | |
|---|---|---|---|---|
| 9,869,272 | B1 * | 1/2018 | Stuart | F01K 23/06 |
| 2014/0103661 | A1 * | 4/2014 | Kacludis | F01K 9/02 290/54 |
| 2016/0003108 | A1 * | 1/2016 | Held | F01K 25/103 60/517 |
| 2018/0179917 | A1 * | 6/2018 | Apte | F01K 3/12 |

FOREIGN PATENT DOCUMENTS

| | | | | |
|---|---|---|---|---|
| WO | WO-2014117924 | A2 * | 8/2014 | F01K 9/003 |

* cited by examiner

*Primary Examiner* — Mark A Laurenzi
*Assistant Examiner* — Xiaoting Hu
(74) *Attorney, Agent, or Firm* — Plager Schack LLP; Mark H. Plager; Michael J. O'Brien

(57) ABSTRACT

A power system is configured to generate mechanical energy from supercritical carbon dioxide in a closed loop. The power system includes a compressor that yields a high pressure supercritical carbon dioxide. A heat exchanger is operatively connected to the compressor and yields a high enthalpy supercritical carbon dioxide. A rotary engine is operatively connected to the heat exchanger and configured to convert thermal energy from the high enthalpy supercritical carbon dioxide into mechanical energy and an output supercritical carbon dioxide. A pressure differential orifice is operatively coupled to the rotary engine and to the heat exchanger and configured to decrease the temperature and the pressure of the output supercritical carbon dioxide resulting in a low pressure low temperature supercritical carbon dioxide. The low pressure low temperature supercritical carbon dioxide is heated in the heat exchanger and the renters the compressor completing the closed loop.

3 Claims, 3 Drawing Sheets

POWER SYSTEM WITH CARBON DIOXIDE WORKING FLUID

RELATED APPLICATION

This application claims priority to provisional patent application U.S. Ser. No. 62/771,510 filed on Nov. 26, 2018, the entire contents of which is herein incorporated by reference.

BACKGROUND

The embodiments herein relate generally to systems that convert thermal energy into mechanical energy.

Prior to embodiments of the disclosed invention, power systems consisted of combustible engines creating environmental emissions, and are not efficient and not economical for consumers. Embodiments of the disclosed invention solve this problem.

SUMMARY

A power system is configured to generate mechanical energy from supercritical carbon dioxide in a closed loop. The power system includes a compressor that yields a high pressure supercritical carbon dioxide. A heat exchanger is operatively connected to the compressor and yields a high enthalpy supercritical carbon dioxide. A rotary engine is operatively connected to the heat exchanger and configured to convert thermal energy from the high enthalpy supercritical carbon dioxide into mechanical energy and an output supercritical carbon dioxide. A pressure differential orifice is operatively coupled to the rotary engine and to the heat exchanger and configured to decrease the temperature and the pressure of the output supercritical carbon dioxide resulting in a low pressure low temperature supercritical carbon dioxide. The low pressure low temperature subcritical carbon dioxide stream is crossed in heat exchanger with high pressure temperature supercritical carbon dioxide stream from discharge port of CO2 compressor resulting in optimum temperatures exiting both discharge ports of heat exchanger. Subcritical stream is heated in the heat exchanger and the renters the compressor completing the closed loop.

BRIEF DESCRIPTION OF THE FIGURES

The detailed description of some embodiments of the invention is made below with reference to the accompanying figures, wherein like numerals represent corresponding parts of the figures.

DETAILED DESCRIPTION OF CERTAIN EMBODIMENTS

Figure 1:
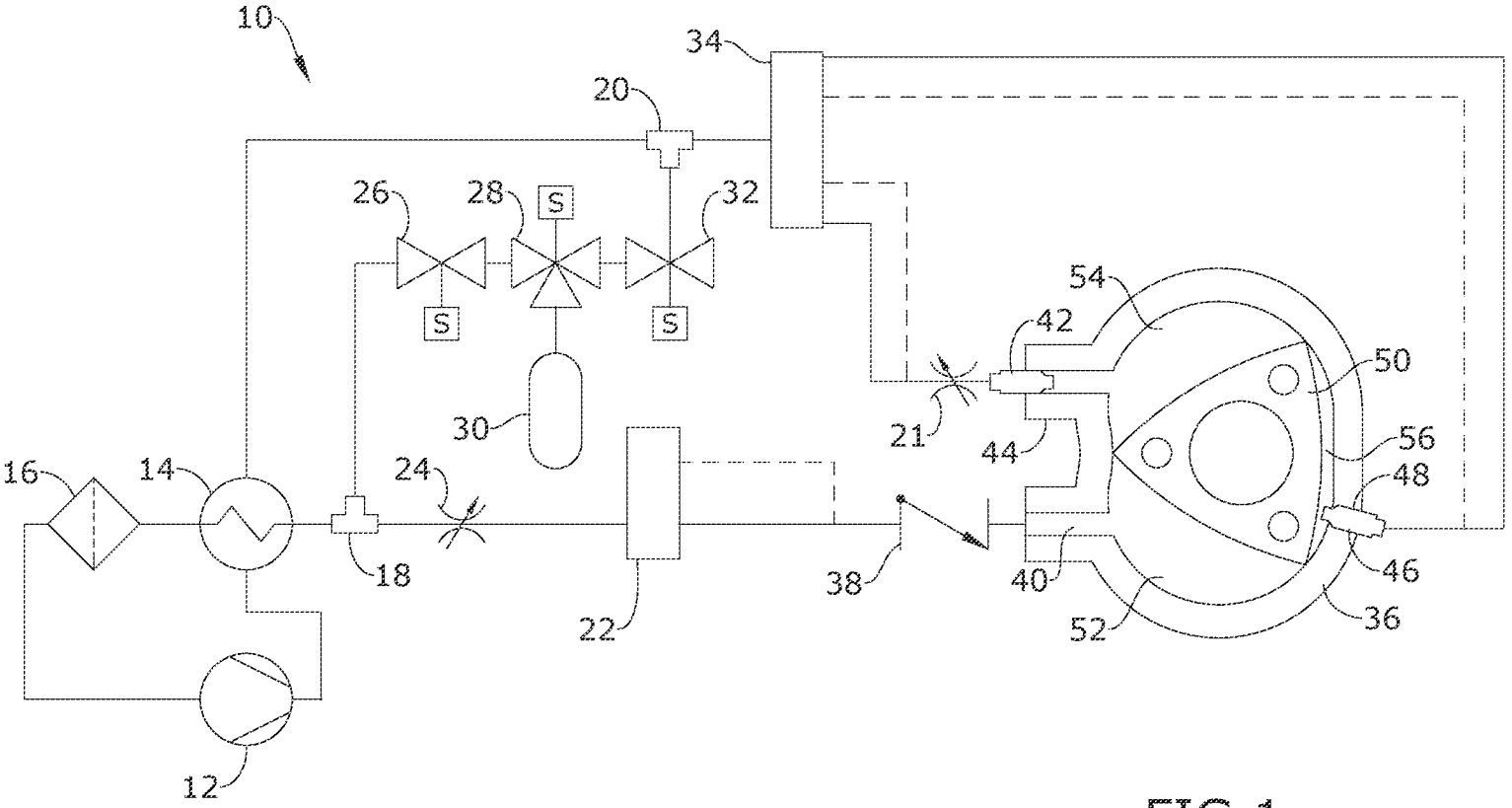
FIG. 1 shows a schematic view of one embodiment of the present invention.

By way of example, and referring to FIG. 1, one embodiment of a power system 10. The power system 10 operates in a closed loop as follows. A compressor 12 is mechanically coupled to a heat exchanger 14 and a coalescent filter 16 with piping. The heat exchanger 14 is mechanically coupled to the coalescent filter 16, a first three-way junction 18, and a three-way junction 20 with piping. The first three-way junction 18 is mechanically coupled to a first manifold 22 with a pressure differential orifice 24 and piping. The first three-way junction 18 is further joined to a first solenoid 26 with piping. A three-way solenoid 28 is mechanically coupled to the first solenoid 26, an accumulator tank 30, and a second solenoid 32 with piping. The second three-way junction 20 is further mechanically coupled to the second solenoid 32 and a second manifold 34.

A rotary engine 36 is mechanically coupled to the first manifold with a check valve 38 at an exhaust port 40. The rotary engine 36 is further mechanically coupled to the second manifold 34 with a first electronic compression injector 42 at a fuel port 44. The rotary engine 36 is further mechanically coupled to the second manifold 34 with a second electronic compression injector 46 at a spark plug port 48.

The rotary engine 36 further comprises a rotor 50. An exhaust chamber 52 is arranged between the rotor 50 and the exhaust port 40. A low-pressure chamber 54 is arranged between the fuel port 44 and the rotor 50. A high-pressure chamber is 56 arranged between the spark plug port 48 and the rotor 50.

The prototype system utilized a Mazda 12*a* rotary engine other rotary engine such as compressed air rotary engine may operate more efficient and require less modifications to engine compared to a combustible rotary or piston engine.

As the CO2 stream exits discharge port of the compressor 12 at 250 degrees Fahrenheit, 600 psi at flow rate of 4 CFM, traveling upstream entering heat exchanger 14 crossing CO2 streams with the cold low-pressure stream created from discharge port of pressure differential 24. The CO2 stream at high pressure side exits the heat exchanger 16 at 96 degrees Fahrenheit, 600 psi and flow rate of 4 CFM traveling upstream to the second manifold 34 where the CO2 stream is split in for streams traveling upstream to the fuel port 44 and the spark plug ports 48. The CO2 stream enters rotary engine 50 at 96 degrees Fahrenheit, 600 psi 4 CFM flow. The compressed CO2 entering rotary engine 50 through four electronic high-pressure injectors 46, 42 moves both the rotors orbital revolutions opening and closing the both injection port 44 and both the spark plug port 48. As the rotor 52 rotates it discharges the CO2 stream out both the exhaust port 40 and immediately out check valve 38 located at the exhaust port 40 so there is no pressure resistance in exhaust chamber 52 in the rotary engine 36. In some embodiments, the CO2 stream can exit the rotary engine 36 through two exhaust ports 40 passing respective check valves 38 and to a manifold 22 to combine the CO2 stream from two streams to one stream CO2 stream at 96 degrees Fahrenheit 600 psi 4 CFM. The CO2 stream travels upstream entering the pressure differential orifice 24. The CO2 stream exits the pressure differential orifice at 25 degrees Fahrenheit 200 psi choked flow. Then the CO2 stream travels upstream to the heat exchanger 14 crossing streams with hot high-pressure stream from discharge port of CO2 compressor. The low pressure CO2 stream exits the heat exchanger 14 at 40 degrees Fahrenheit 200 psi. The CO2 stream then travels upstream to a suction port of the compressor 12 which is configured to create a volumetric flow change exiting a discharge port of the compressor 12 at 190 degrees Fahrenheit, 600 psi 4 CFM in a continuous closed loop system.

A user can increase and decrease rotational speed of the rotary engine 36 by throttling and de-throttling the carbon dioxide flow. The accumulator tank 30 is joined to an L type 3-way electronic solenoid valve 28 coupled to the first solenoid expansion valve 26 and the second solenoid expansion valve 32. One solenoid valve can be used to transfer carbon dioxide from the accumulator tank to the flow, increasing the flow and another can be used to transfer carbon dioxide into the accumulator tank, decreasing the flow rate.

When throttling occurs the 3-way valve 28 opens to allow CO2 to exit from accumulator tank 30 at rate set by a control module up to 400 psi to enter the first electronic expansion solenoid valve 26 then open the first solenoid valve 26 traveling upstream to branched off first three-way-junction 18 at low pressure side of system. The CO2 stream from the accumulator tank 30 pressure decreases from 600 psi down to 400 psi equalizing the pressure of the low-pressure side of system increasing system pressure from 200 psi to 400 psi at three-way junction 18. Pressurized CO2 then travels upstream entering the suction port of the compressor 12 at 400 psi increasing the volumetric flow rate from 4 CFM to 8 CFM. The increased flow rate increases the discharge pressure at discharge port of compressor 12 from 600 psi to 800 psi. Likewise, increased pressure and flow increases the rotational speed of the rotary engine 36.

When de-throttling occurs the three-way solenoid valve 28 opens to allow CO2 to enter the accumulator tank 30. The second solenoid valve 32 opens to allow carbon dioxide to enter the three-way solenoid valve 28 and thus into the accumulator tank 30. CO2 stream from the second three-way junction 20 is at the high pressure side of system. After depressurizing from 800 psi to 600 psi depressurizing is complete when accumulator tank 30 and high-pressure side are equal pressure at 600 psi. This would be considered idle.

Figure 2:
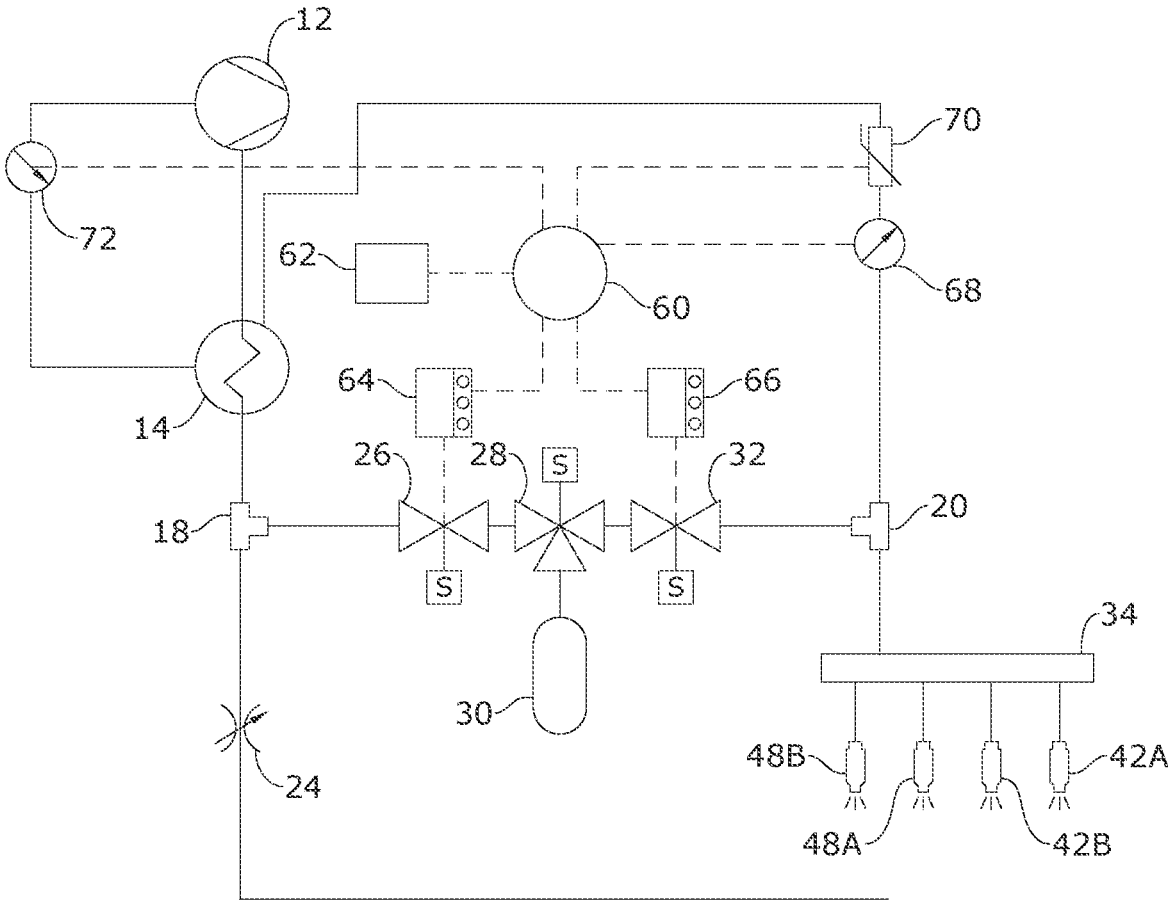
FIG. 2 shows a schematic view of one embodiment of the present invention.

Turning to FIG. 2, a controller 60 is electrically coupled to a control module for throttling and de-throttling 62, a first solenoid valve positioner 64, a second solenoid valve positioner 66, a high pressure side pressure transducer 68, a high pressure side temperature transducer 70, and a low pressure side temperature transducer 72 as is shown by dotted lines. This embodiment has the second manifold 34 mechanically coupled to a first electronic compression injector 42A, a second electronic compression injector 48A, a third electronic compression injector 42B, a fourth electronic compression injector 48B. The pressure and temperature readings above are collected by the transducers. The controller 60 then adjusts as necessary to adjust rotational speed as necessary.

Figure 3:
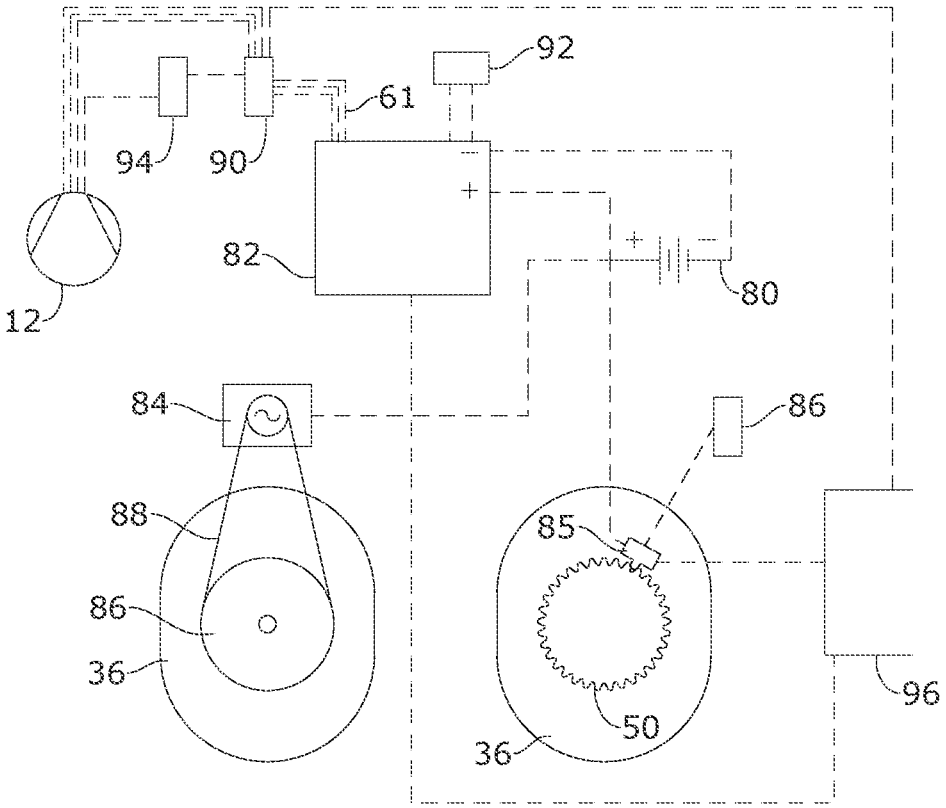
FIG. 3 shows a schematic view of one embodiment of the present invention.

Turning to FIG. 3, battery 80 is electrically coupled to inverter 82 and alternator 84. The alternator 84 is connected to a flywheel 86 with a belt 88. The flywheel 86 is mechanically coupled to the rotor 50 on the rotary engine 36. The schematic separates the rotor 50 from the rotary engine 36 for clarity. The inverter 82 is further electrically coupled to a starter 85 on the rotor 50. An ignition switch 86 is communicatively coupled to the starter 85 to engage the starter 85.

The inverter 82 is further electrically coupled to a compressor ground fault circuit interceptor 90 and a module ground fault circuit interceptor 92. The compressor ground fault circuit interceptor 92 is electrically coupled to the compressor 12 with a switch 94. The module ground fault circuit interceptor 92 provides electrical power as needed throughout the power system 10. Inverter 82, starter 85 and compressor ground fault circuit interceptor 90 are all electrically coupled to ground 96.

As used in this application, the term "a" or "an" means "at least one" or "one or more."

As used in this application, the term "about" or "approximately" refers to a range of values within plus or minus 10% of the specified number.

As used in this application, the term "substantially" means that the actual value is within about 10% of the actual desired value, particularly within about 5% of the actual desired value and especially within about 1% of the actual desired value of any variable, element or limit set forth herein.

All references throughout this application, for example patent documents including issued or granted patents or equivalents, patent application publications, and non-patent literature documents or other source material, are hereby incorporated by reference herein in their entireties, as though individually incorporated by reference, to the extent each reference is at least partially not inconsistent with the disclosure in the present application (for example, a reference that is partially inconsistent is incorporated by reference except for the partially inconsistent portion of the reference).

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever.

Any element in a claim that does not explicitly state "means for" performing a specified function, or "step for" performing a specified function, is not to be interpreted as a "means" or "step" clause as specified in 35 U.S.C. § 112, 6. In particular, any use of "step of" in the claims is not intended to invoke the provision of 35 U.S.C. § 112, 6.

Persons of ordinary skill in the art may appreciate that numerous design configurations may be possible to enjoy the functional benefits of the inventive systems. Thus, given the wide variety of configurations and arrangements of embodiments of the present invention the scope of the invention is reflected by the breadth of the claims below rather than narrowed by the embodiments described above.

What is claimed is:

1. A power system, configured to generate mechanical energy from subcritical and supercritical carbon dioxide in a closed loop; the power system comprising:

a compressor configured to increase a pressure and flow rate of the supercritical carbon dioxide resulting in a high pressure supercritical carbon dioxide;

a heat exchanger, operatively connected to the compressor and to a first manifold through a pressure differential orifice; wherein the heat exchanger is configured to cross a hot carbon dioxide stream from the compressor and a cold carbon dioxide stream comprising a low pressure low temperature subcritical carbon dioxide from the pressure differential orifice resulting in a high enthalpy supercritical carbon dioxide that is delivered to a second manifold;

a rotary engine, mechanically coupled to the first manifold with a check valve at an exhaust port; wherein the rotary engine is further mechanically coupled to the second manifold with a first electronic compression injector at a first injector port and a second electronic compression injector at a second injection port; and wherein the rotary engine is configured to convert pressure and flow from the high enthalpy supercritical carbon dioxide into mechanical energy and an output supercritical carbon dioxide;

wherein the pressure differential orifice is operatively coupled to the rotary engine and to the heat exchanger and configured to decrease the temperature and the pressure of the output supercritical carbon dioxide resulting in the low pressure low temperature subcritical carbon dioxide;

wherein the low pressure low temperature subcritical carbon dioxide is heated in the heat exchanger and then enters the compressor completing the closed loop.

2. The power system of claim 1, further comprising:

a three-way electronic solenoid valve, mechanically coupled to an accumulator tank;

a first solenoid expansion valve, operatively coupled to the three-way electronic solenoid valve and to the power system where the low pressure low temperature subcritical carbon dioxide travels;

wherein opening the three-way electronic solenoid valve and the first solenoid expansion valve causes supercritical carbon dioxide to travel from the accumulator tank toward the heat exchanger and increases the pressure of the low pressure low temperature subcritical carbon dioxide.

3. The power system of claim 2, further comprising:

a second solenoid expansion valve, operatively coupled to the three-way electronic solenoid valve mechanically coupled to the accumulator tank and to the power system where the high enthalpy supercritical carbon dioxide travels;

wherein opening the three-way electronic solenoid valve and the second solenoid expansion valve causes supercritical carbon dioxide to travel from the heat exchanger into the accumulator tank and decreases the pressure of the high enthalpy supercritical carbon dioxide.

* * * * *